US011591177B2

(12) United States Patent
Fleet et al.

(10) Patent No.: US 11,591,177 B2
(45) Date of Patent: Feb. 28, 2023

(54) TAPE MACHINE

(71) Applicants: Richard Scott Fleet, Belding, MI (US); Ron Sheler, Belding, MI (US)

(72) Inventors: Richard Scott Fleet, Belding, MI (US); Ron Sheler, Belding, MI (US)

( * ) Notice: Subject to any disclaimer, the term of this patent is extended or adjusted under 35 U.S.C. 154(b) by 54 days.

(21) Appl. No.: 17/471,523

(22) Filed: Sep. 10, 2021

(65) Prior Publication Data

US 2022/0097998 A1 Mar. 31, 2022

Related U.S. Application Data

(63) Continuation of application No. 16/583,891, filed on Sep. 26, 2019, now Pat. No. 11,155,433.

(51) Int. Cl.
*B65H 35/00* (2006.01)

(52) U.S. Cl.
CPC ..... *B65H 35/0086* (2013.01); *B65H 2301/51512* (2013.01); *B65H 2301/51535* (2013.01); *B65H 2701/377* (2013.01); *Y10T 156/1348* (2015.01); *Y10T 156/1357* (2015.01); *Y10T 156/1361* (2015.01); *Y10T 156/1365* (2015.01)

(58) Field of Classification Search
CPC ..... B65H 35/0086; B65H 2301/51512; E04F 21/1657; E01C 23/185; Y10T 156/1348; Y10T 156/1357; Y10T 156/1361; Y10T 156/1365
See application file for complete search history.

(56) References Cited

U.S. PATENT DOCUMENTS 2,192,634 A * 3/1940 Blomquist ..... A43D 43/06 156/523
3,393,114 A * 7/1968 Jorgensen ..... E01C 23/185 156/577
4,313,780 A * 2/1982 Ford, Jr. ..... E01C 23/185 156/577

* cited by examiner

*Primary Examiner* — George R Koch
*Assistant Examiner* — Christopher C Caillouet
(74) *Attorney, Agent, or Firm* — Varnum LLP

(57) ABSTRACT

A tape machine includes a base, one or more wheels connected to the base, one or more uprights extending upwards from the base, a roller connected to the base, and a tape roll housing connected to the uprights and configured to receive a roll of tape therein to allow for rotational unwinding of the roll of tape. A cutter connected to the base and moveable between an idle position and a cut position. A blade on the cutter is moveable to cut the tape when in cut position.

20 Claims, 9 Drawing Sheets

TAPE MACHINE

CROSS REFERENCE TO RELATED APPLCIATIONS

This application is a continuation of and claims the benefit of U.S. Non-Provisional Patent application Ser. No. 16/583,891 filed on Sep. 26, 2019, U.S. Pat. No. 11,155,433, which is hereby incorporated by reference in its entirety.

FIELD OF INVENTION

The present invention relates to the field of adhesive tape application and more specifically to an apparatus and related method for applying tape along a surface.

BACKGROUND

Participants in a variety athletic events and activities use mats for protection. Commonly, mats are used to provide a cushioned surface on the floor of a gymnasium for events such as wrestling and gymnastic meets. In some cases, mats are provided in multiple sections, which may be done for ease of storage and shipping. In use, however, the sections of the mat must be connected together before an event to prevent them from sliding and slipping.

Commonly, mats are taped together to keep them connected. However, applying the tape to connect the mats may prove to be challenging in several regards. First, application using a roll of tape requires that the person applying the tape do so from a crouched position or on their hands and knees. This can be difficult especially in large gyms with many mats. Further, to ensure that the mats are effectively connected the tape may need to be smoothed over or pressed down, which then requires a second operation beyond applying the tape. Lastly, even when applying in a crouched position, it may be difficult to maintain proper alignment of the tape to keep the tape equally positioned along the border of abutting mats. Any variations in the tape alignment may lead to weak connections.

For at least these reasons, an improved adhesive tape application method and device are needed.

SUMMARY

A tape machine for applying tape to a supporting surface is generally presented. The tape machine includes a base having a front end and a rear end and one or more wheels connected to the base. The tape machine further includes one or more uprights extending upwards from the base. A tape roll housing is connected to the upright and configured to receive a roll of tape therein to allow for rotational unwinding of the roll of tape. A roller may be connected to the base. The roller may comprise an elongate wheel configured to receive tape from a tape roll and to roll along the supporting surface. The tape machine may include a cutter connected to the base. The cutter may be moveable between an idle position and a cut position. The cutter may include a blade that is configured to move across at least a portion of its length to cut tape that is extended between a roll of tape positioned in the tape roll housing and the roller.

In an embodiment, the cutter may be actuated between an idle position and a cut position by a cutter position lever. The cutter position lever may be cable actuated or actuated using any other appropriate means, such as other mechanical, pneumatic, or electrical means. The cutter blade may be actuated by a blade actuation lever. The blade actuation lever may be cable actuated or actuated using any other appropriate means, such as other mechanical, pneumatic, or electrical means.

In an embodiment, the base may be angled forward such that the front end of the base is closer to the supporting surface than the back end of the base. The tape machine upright may comprise two upright members extending upwards from opposite sides of the base. A handle may extend from or through the uprights. A laser guide may be positioned on or between the uprights and configured to direct a laser point to a location in front of the tape machine.

In an embodiment, a method of interconnecting two gymnasium mats includes providing a tape machine. The tape machine includes a base having a front end and a rear end and one or more wheels connected to the base. The tape machine further includes at least one upright extending upwards from the base, a tape roll housing connected to the upright and configured to receive a tape roll therein, and a roller connected to the base. A cutter is connected to the base and moveable between an idle position and a cut position. The cutter includes a blade that is configured to move across a length of the cutter. The method further includes the steps of: inserting a roll of tape into the tape housing to allow the roll of tape is configured to rotate within the tape housing; unwinding the roll of tape and extending the unwound portion of tape around the roller; directing the tape machine along a surface between two mats to apply the tape to both mats; actuating a cutter position lever to move the cutter from idle position to a cut position; and actuating a blade actuation lever to move the blade along the cutter and cut the tape.

BRIEF DESCRIPTION OF THE DRAWINGS

The operation of the invention may be better understood by reference to the detailed description taken in connection with the following illustrations, wherein.

DETAILED DESCRIPTION

Figure 1:
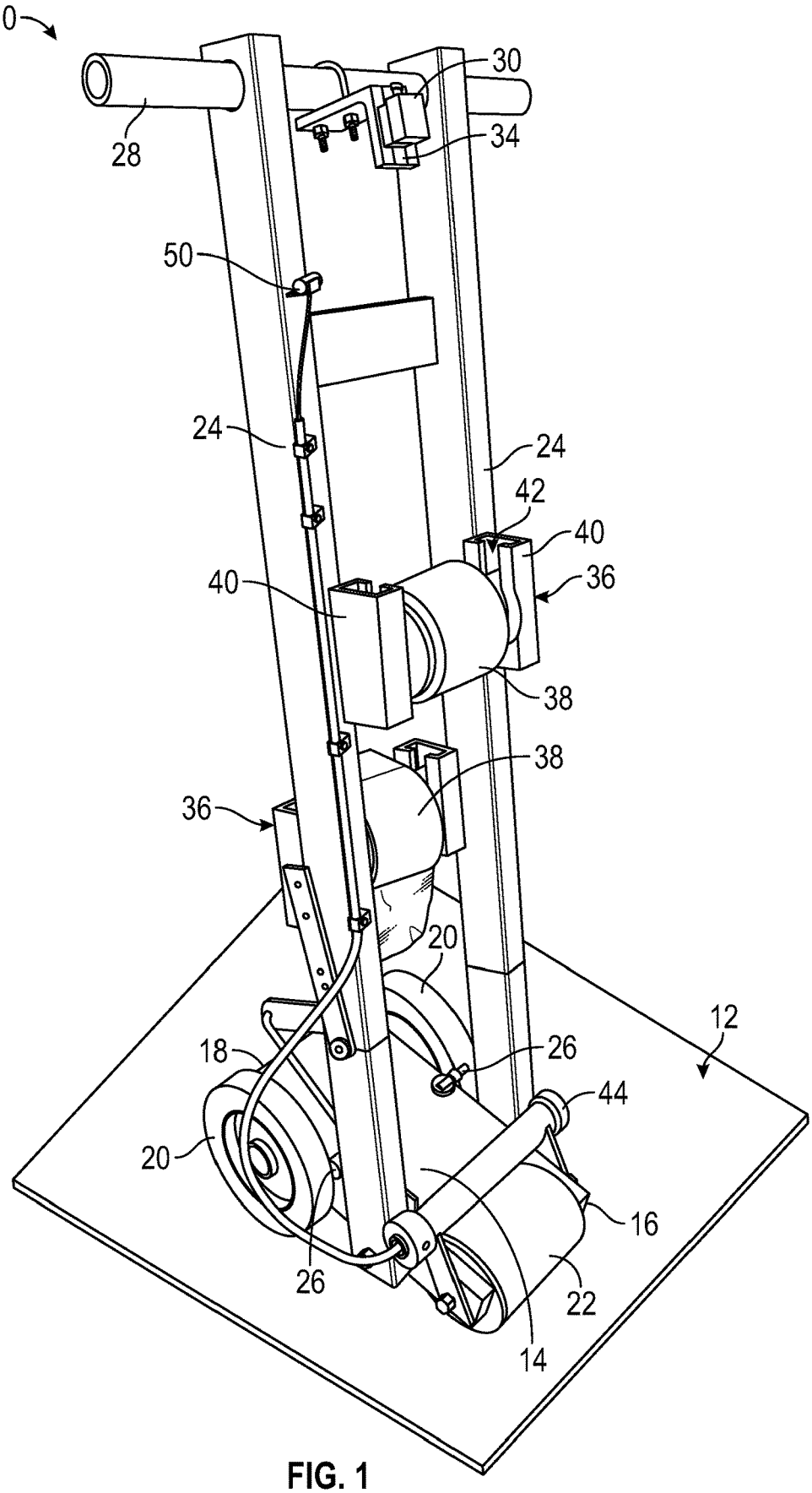
FIG. 1 illustrates a perspective view of a tape rolling machine.
Figure 2:
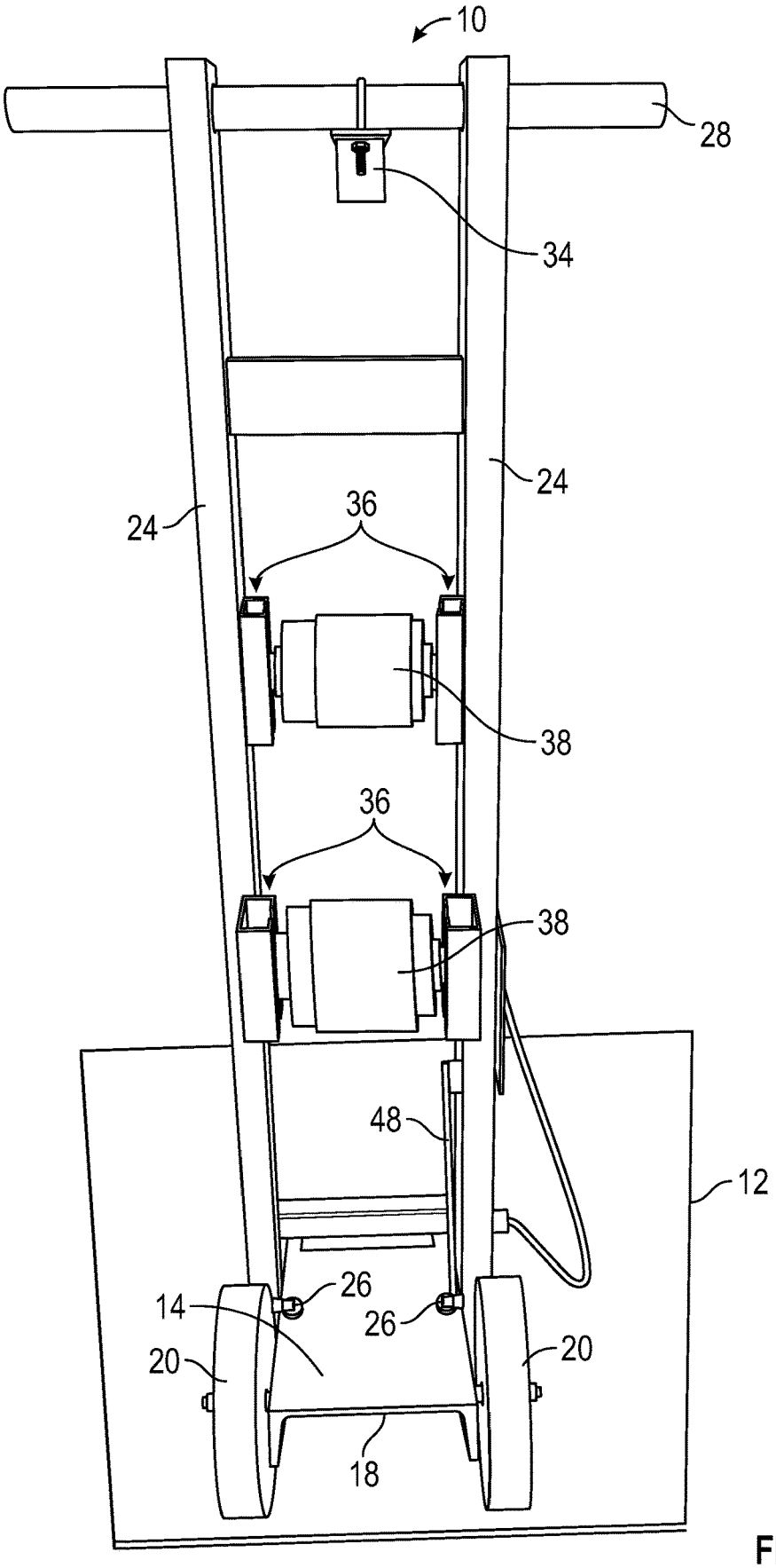
FIG. 2 illustrates a rear view of a tape rolling machine.
Figure 3:
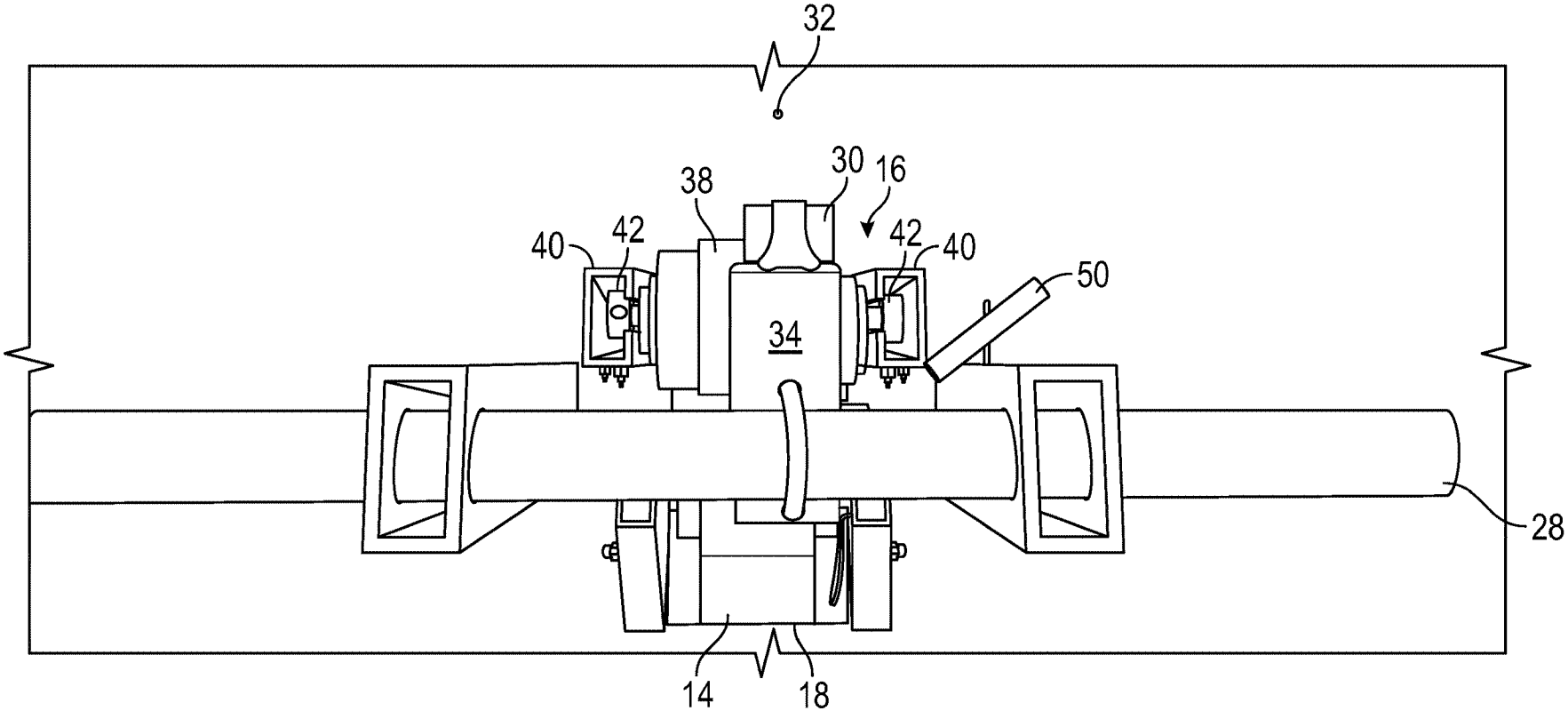
FIG. 3 illustrates a top view of a tape rolling machine.
Figure 4:
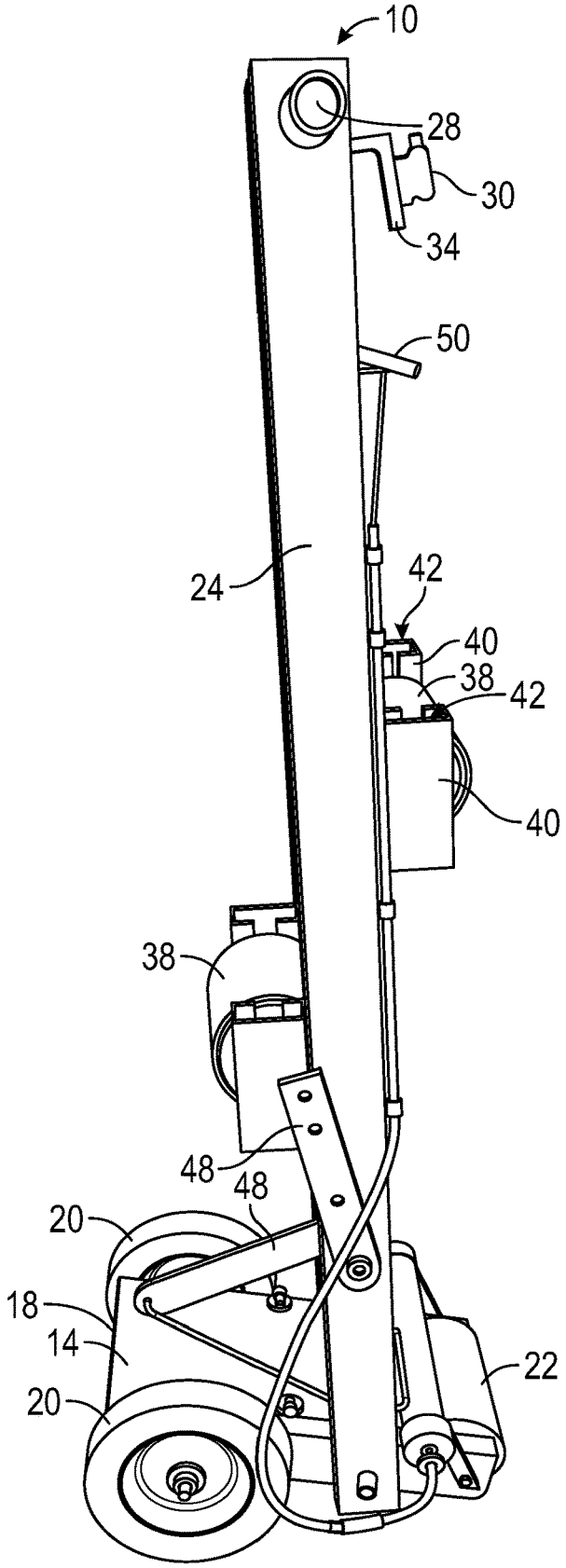
FIG. 4 illustrates a side view of a tape rolling machine.
Figure 5:
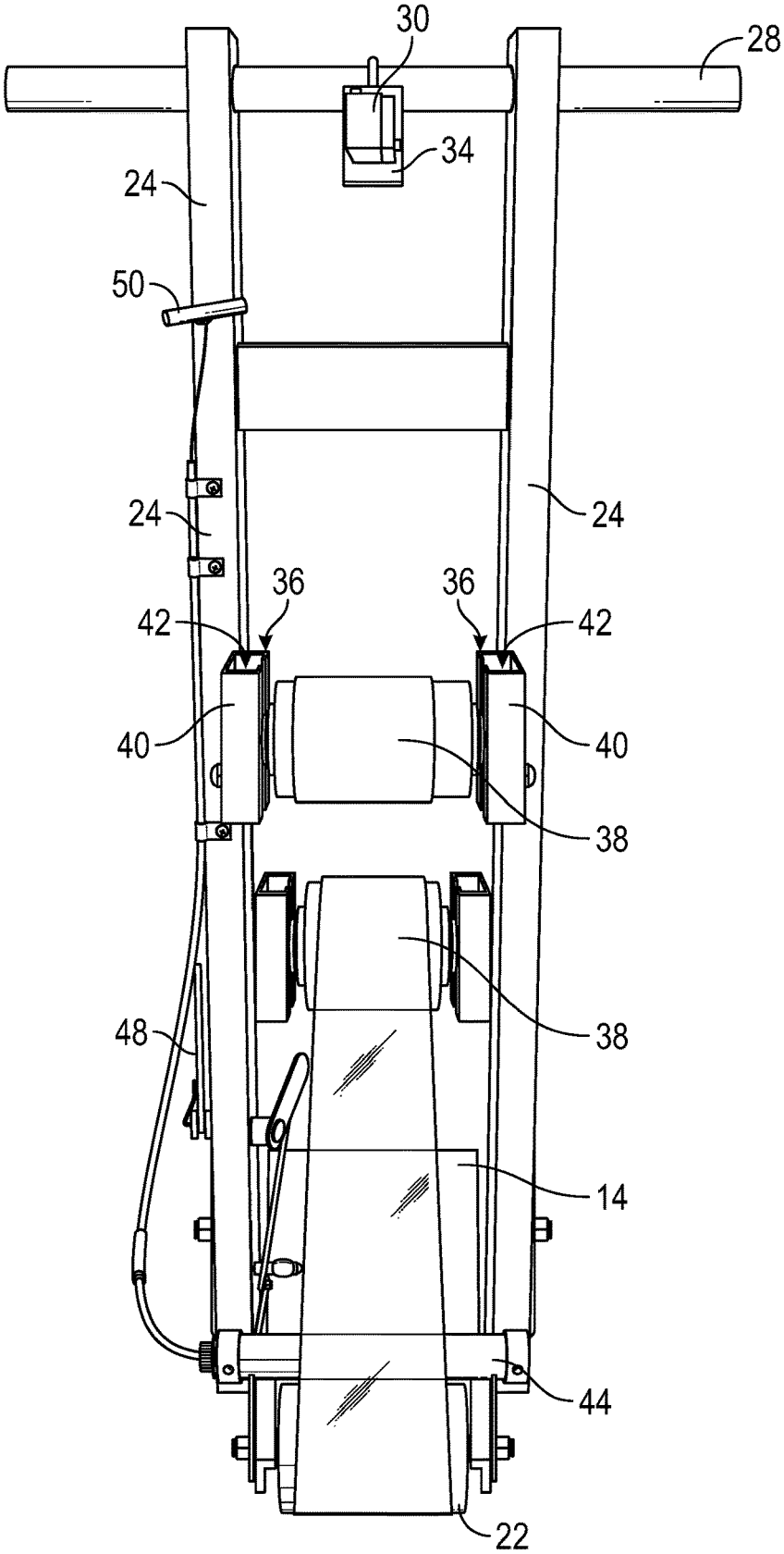
FIG. 5 illustrates a front view of a tape rolling machine.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A tape rolling machine, or tape machine 10, is generally presented, as illustrated in FIGS. 1-8. The tape machine 10 is configured to receive a roll of adhesive tape and to apply the adhesive tape along a surface 12, such as a floor or supporting surface. As described herein, the tape machine may specifically be used to tape and secure two devices together, such as mats or the like.

The tape machine 10 may comprise a base 14 positioned at or near the bottom of the machine. The base 14 may be formed of any appropriate material, such as steel, aluminum, or the like. The base 14 may comprise a front end 16 and a rear end 18, where the tape machine 10 is generally configured to move in the direction of the front end 16. The base 14 may be any appropriate size, such as having a 12-inch or 14-inch length and a width from side to side that is sufficient to accommodate different and larger sizes of tape rolls, as set forth in further detail below.

The base 14 may include wheels 20 attached at or near the rear end 18. The wheels 20 may be connected to an axel that is connected to or through the base 14. The wheels 20 may provide rolling support for moving the tape machine 10 along a floor surface 12.

The base 14 may include one or more rollers 22 at or near its front end 16. The roller 22 may comprise an elongate wheel, such as a five-inch wide roller wheel, configured to press against a supporting floor or surface 12 as the tape machine 10 is guided or directed along the surface 12. The roller 22 may be configured to receive the tape stretched thereover with the non-adhesive side facing inward toward the roller 22 and the adhesive side facing outward and toward the floor surface 12 to which the tape is to be applied.

The tape machine 10 may include one or more uprights 24, such as two upright members, connected to the base 14. The uprights 24 may extend generally upwards or slightly angled from the base 14. The uprights 24 may be formed of any appropriate material, such as steel, aluminum, or the like. The uprights 24 may be pivotable with respect to the base 14. For example, the tape machine 10 may include two uprights 24 connected to opposite outer side surfaces of the base 14 between the wheels 20 and the roller 22. The connections to the base 14 may allow for rotational movements of the uprights 24. The base 14 may include a hard stop 26 between the wheels 20 and the upright connection to prevent the uprights 24 from being pivoted into the wheels 20. The hard stops 26 may comprise protrusions that extend outward from both sides of the base 14.

A handle 28 may be connected to a top portion of the uprights 24 to allow a user to direct and guide the tape machine 10. The handle 28 may extend through the top portion of the uprights 24 or two handles 28 may each extend outward from the sides of each upright. The handles 28 may optionally include grips, such as rubber or foam grips attached thereon.

The tape machine 10 may include a directional guide, such as a laser guide 30. The laser guide 30 may be mounted on any appropriate portion of the tape machine, such as the uprights 24 or base 14, and directed to shine a laser point at a position in front of the tape machine 10, preferably at a point perpendicular to the center of the base 14 and in front of the base 14. The laser point 32 generated by the direction guide 30 may allow for continued alignment of the tape during application and prevent skewed application. The laser guide 30 may be mounted between the upright 24s, such as centrally between the uprights 24. The laser guide may be mounted on a bracket 34 or using other supporting components. However, it will be appreciated that the laser guide 30 may be mounted at any desired location on the tape machine 10 that allows for a laser point 32 to be generated at the desired lead location in front of the machine 10.

The tape machine 10 may include one or more tape roll housings 36. Each tape roll housing 36 may be configured to hold a roll of adhesive tape 38 therein and allow for rotation of the tape roll 38 therein to unwind the tape as it is applied to the floor 12. The tape roll housings 36 may be connected to the uprights 24, such as a first and second holder bracket 40 connected to each upright 24. The holder brackets 40 may each include a slot 42 therein to receive an axle from a tape roll 38. The brackets 40 may be any appropriate distance apart, such as five inches apart to allow for any width of tape roll up to five inches.

In an embodiment, the tape machine 10 may include two or more tape roll housings 36, such as one tape roller positioned on the front side of the uprights 24, and one positioned on the rear side of the uprights 24, as illustrated in FIGS. 1, 2, 4, and 5. The additional tape roll housing 36 may allow for storage of a second roll of tape or use of a second roll of tape of a different size than the first roll.

The tape machine 10 may include a cutter 44. The cutter 44 may be generally configured to cut the tape when application is complete. The cutter 44 may comprise a blade 46 that is movable along a length of the cuter, such as a cylinder having an actuated blade 46. The blade 46 may be moveable from a first end of the cylinder to a second end of the cylinder, or along any portion of the cylinder, to slice any tape that is in the blade's path.

Figure 6:
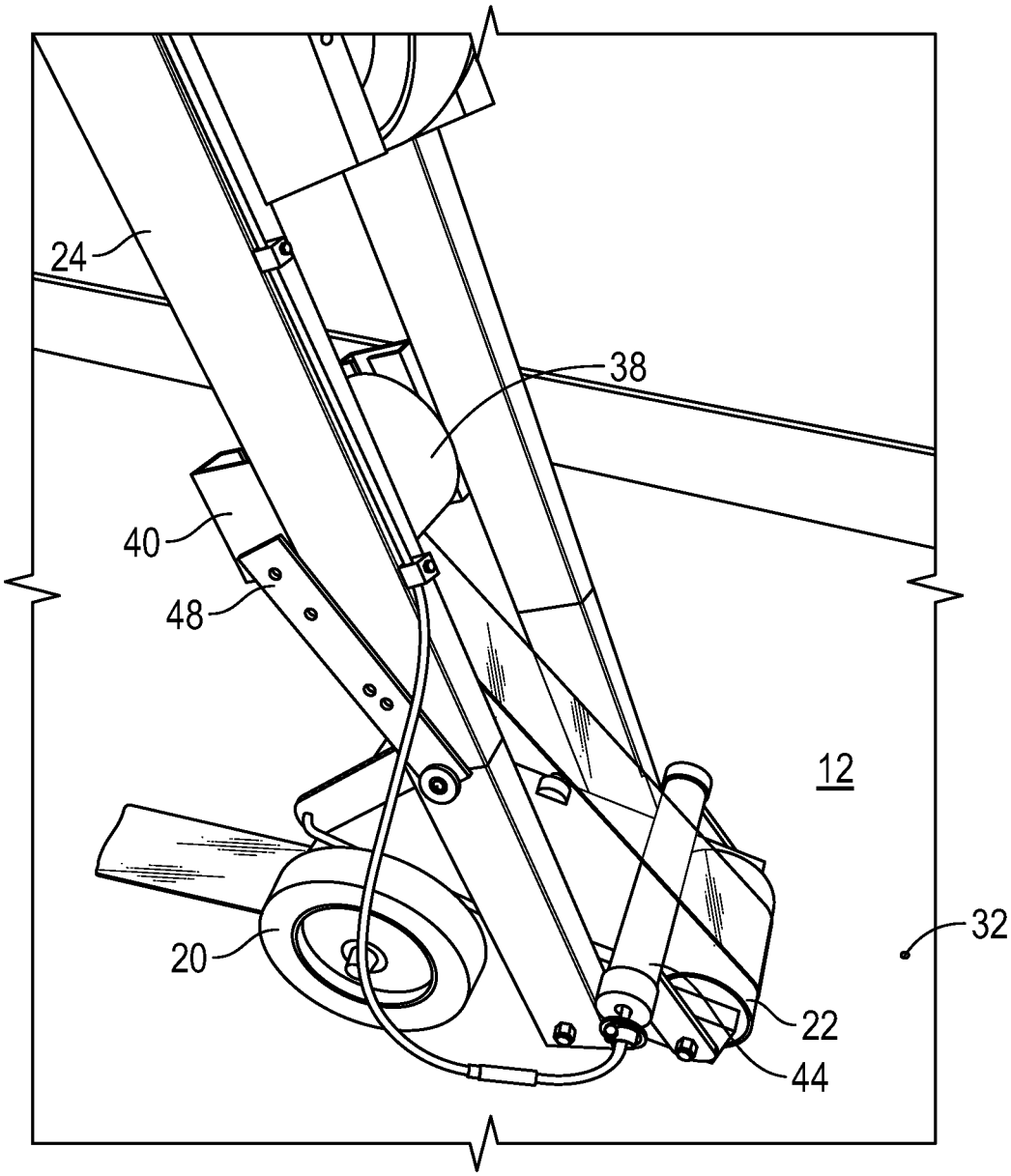
FIG. 6 illustrates a tape rolling machine applying tape to a floor surface with the cutter in idle position.
Figure 7:
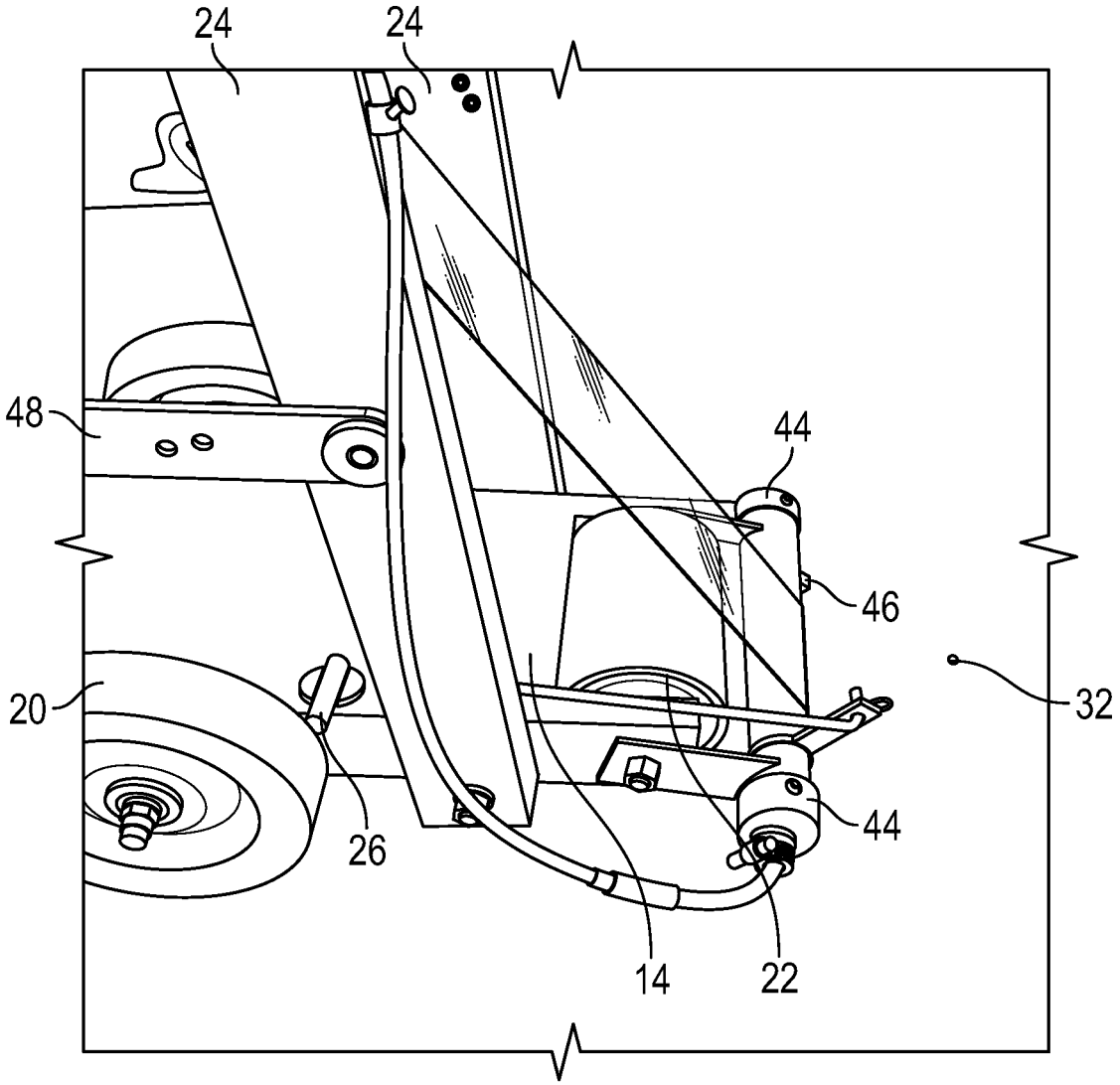
FIG. 7 illustrates a tape rolling machine applying tape to a floor surface with the cutter in cut position.
Figure 8:
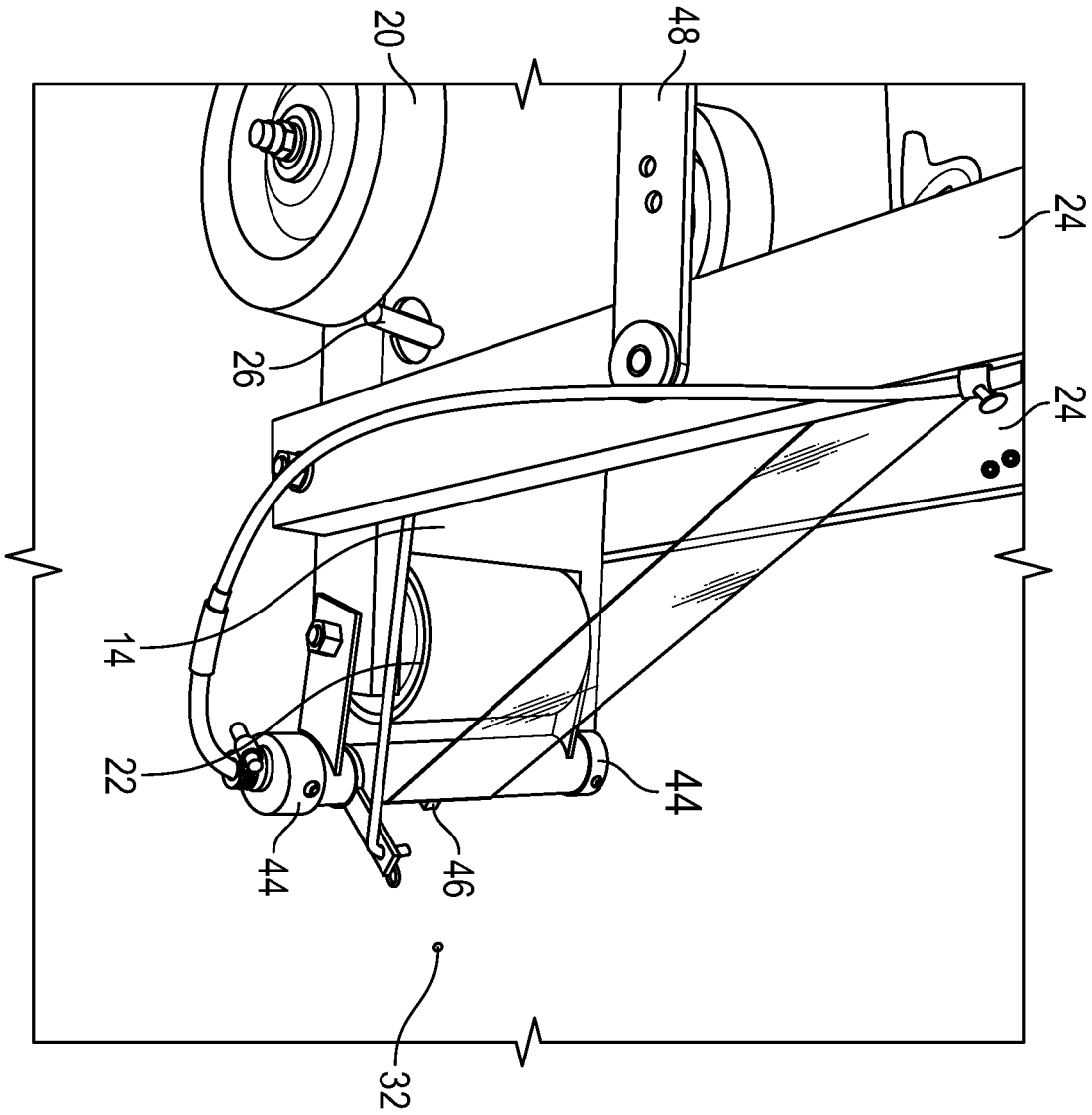
FIG. 8 illustrates a tape rolling machine applying tape to a floor surface with the cutter in cut position and the blade actuated.

The cutter 44 may be pivotable between an idle position (as shown in FIG. 6) and a cut position (as shown in FIGS. 7 and 8). In idle position, the cutter 44 may be positioned away from the unrolled tape, which is stretched around the roller 22. For example, as shown in FIG. 6, the cutter 44 is rested against the base 14 and pivoted away from the unrolled tape. To engage the cutter 44 into cut position, it may be pivoted forward toward the unrolled tape. For example, as shown in FIGS. 7 and 8, the cutter 44 may be pivoted forward to a position in front of the base 14 and roller 22 and adjacent to the unrolled tape. The cuter 44 may engage and push the tape in cut position to prepare the tape for cutting.

Figure 9:
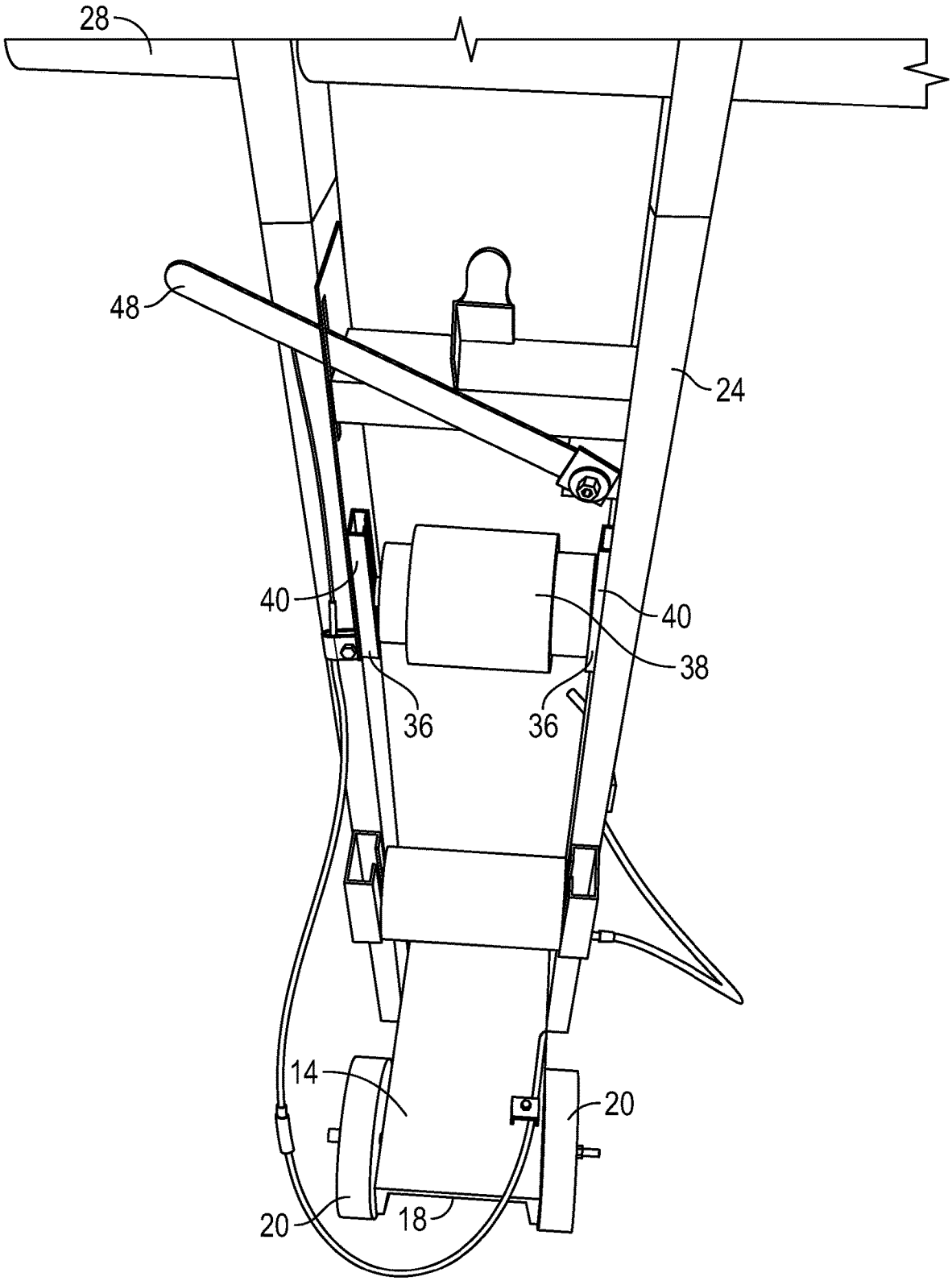
FIG. 9 illustrates a tape rolling machine having a cable actuated cutter position handle.

It will be appreciated that the cutter 44 may be actuated from idle position to pivot position by any appropriate means or mechanical or electrical devices or linkages. For example, the cutter 44 may be actuated by a lever 48 as shown in FIGS. 6-9 between the idle and cut positions. However, the cutter 44 may alternatively be mechanically actuated by a cable connector. For example, the cutter 44 may include a cable attached to a pivoting linkage near the base 14, as illustrated in FIG. 9. The cable may be routed to an actuation lever 48 at or near the handle 28 to allow for a user who is directing the machine to move the cutter 44 into cut position by actuating the lever. Alternatively, the tape machine 10 may include an electrical switch or button to power an electrical actuator, such as a solenoid, to move the cutter 44 to cut position. Further, any other means of moving the cutter 44, such as using air power or other known means, may be utilized.

The cutter 44 may further include a blade actuation lever 50. The blade actuation lever 50 may be configured to actuate movement of the blade from one side of the cutter 44 to the other side to cut the tape. The blade actuation lever 50 may be a cable actuated lever or any other type of mechanical or electrical actuation device. The blade actuation lever 50 may be located on or near the uprights 24 or handle 28, as illustrated in the drawings.

In an embodiment, the roller 22 may comprise two roller wheels, such as two two-inch roller wheels, spaced apart. For example, the two rollers may be spaced apart by a spacer bar, such as a one-inch spacer bar. The spacer bar may provide a space between the rollers 22 that has a reduced diameter to allow for other components to be fed through the roller 22 along with the tape. For example, a tape roll may include a cabling, such as an electrical cord, communication cable, or the like, integrated and rolled with the tape. The tape machine 10 may be configured to apply both the tape and cabling to a floor surface 12 simultaneously.

In use, the tape machine 10 is loaded with one or more rolls of tape inserted into a tape roll housing 36. Each roll of tape 38 is inserted into a slot 42 in the tape roll housing 36 and unwound. The tape is fed to the roller 22 with an adhesive side of the tape facing outward as applied to the roller 22. The tape is then applied to a floor surface 12 supporting the tape machine along a line directed by the laser guide 30. Once taping is complete, the cutter 44 is pivoted from idle position to cut position by activating a lever 48. The lever 48 may pivot the cutter forward toward the tape and engage the cutter 44 with the tape.

In an embodiment, the tape machine 10 may be utilized to apply or lay other types of coiled products onto a floor surface 12. For example, coiled wire, cabling, piping, adhesive, coloring, or other coiled devices or products may be inserted into the tape roll housings 36. The products may then be stretched over the roller 22 or inserted/directed into a spacing between the roller 22 and rolled onto a supporting floor surface 12.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

What is claimed is:

1. A method of interconnecting a plurality of adjoining substrates, the method comprising:
- providing a tape machine, wherein the tape machine comprises:
  - a base having a front end and a rear end, wherein the front end is disposed closer to the plurality of adjoining substrates than the rear end;
  - one or more wheels connected to the base;
  - an upright extending upwardly from the base;
  - a tape roll housing connected to the upright and configured to receive a tape roll therein;
  - a roller connected to the base;
  - a cutter connected to the base, the cutter comprising a cylinder having a blade connected thereto and configured to move along an outer surface of the cylinder, wherein the cutter is movable between an idle position, wherein the blade is disposed away from the tape and behind the roller and a cut position, wherein the blade is disposed between the roller and the tape, and wherein the blade is configured to move across a length of the cutter;
- inserting a tape roll into the tape housing, such that the tape roll is rotatable within the tape housing;
- unwinding the tape roll and extending a portion of the tape in contact with and about the roller, such that an adhesive side of the tape is disposed opposite the roller and configured to be applied to the plurality of adjoining substrates;
- positioning a tape machine in a first position upon the plurality of adjoining substrates;
- directing the tape machine to a second position upon the plurality of adjoining substrates, thereby applying the tape to the plurality of adjoining substrates from the first position to the second position;
- actuating a cutter position lever to move the cutter from an idle position to a cut position; and
- actuating a blade actuation lever to move the blade across a length of the cutter thereby cutting the tape.

2. The method of claim 1 wherein the cutter position lever is cable actuated.

3. The method of claim 1 wherein the blade actuation lever is cable actuated.

4. The method of claim 1 wherein the upright comprises a pair of upright members extending upwardly from opposing sides of the base; and
- wherein the tape machine further comprises a handle that extends between the pair of upright members.

5. The method of claim 4 wherein the tape machine further comprises a laser guide operatively coupled to the handle, wherein the laser guide is configured to direct a laser point at a location in front of the tape machine.

6. The method of claim 1 wherein the plurality of adjoining substrates is a plurality of gymnasium mats.

7. The method of claim 1 wherein the plurality of adjoining substrates is one of a plurality of insulation sheets or a plurality of insulation boards.

8. The method of claim 1 wherein the fixed substrate is one of a floor, wall, or ceiling.

9. The method of claim 8 wherein the elongated object is a utility cord.

10. A method of securing an elongated object to a fixed substrate, the method comprising:
- providing a tape machine, wherein the tape machine comprises:
  - a base having a front end and a rear end, wherein the front end is disposed closer to the fixed substrate than the rear end;
  - one or more wheels connected to the base;
  - an upright extending upwardly from the base;
  - a tape roll housing connected to the upright and configured to receive a tape roll therein;
  - a roller connected to the base;
  - a cutter connected to the base, the cutter comprising a cylinder having a blade connected thereto and configured to move along an outer surface of the cylinder, wherein the cutter is movable between an idle position, wherein the blade is disposed away from the tape and behind the roller and a cut position, wherein the blade is disposed between the roller and the tape, and wherein the blade is configured to move across a length of the cutter;
- inserting a tape roll into the tape housing, such that the tape roll is rotatable within the tape housing;
- unwinding the tape roll and extending a portion of the tape in contact with and about the roller, such that an adhesive side of the tape is disposed opposite the roller and configured to be applied to and couple the elongated object and the fixed substrate;
- positioning a tape machine in a first position upon each of the elongated object and the fixed substrate;

directing the tape machine to a second position upon each of the elongated object and the fixed substrate, thereby applying the tape to each of the elongated object and the fixed substrate and coupling the elongated object to the fixed substrate from the first position to the second position;

actuating a cutter position lever to move the cutter from an idle position to a cut position; and actuating a blade actuation lever to move the blade across a length of the cutter thereby cutting the tape.

11. The method of claim 10 wherein the cutter position lever is cable actuated.

12. The method of claim 10 wherein the blade actuation lever is cable actuated.

13. The method of claim 10 wherein the upright comprises a pair of upright members extending upwardly from opposing sides of the base; and wherein the tape machine further comprises a handle that extends between the pair of upright members.

14. The method of claim 13 wherein the tape machine further comprises a laser guide operatively coupled to the handle, wherein the laser guide is configured to direct a laser point at a location in front of the tape machine.

15. A method of forming boundary lines on a fixed substrate to create a field of play, the method comprising:

providing a tape machine, wherein the tape machine comprises:

a base having a front end and a rear end, wherein the front end is disposed closer to the fixed substrate than the rear end;

one or more wheels connected to the base;

an upright extending upwardly from the base;

a tape roll housing connected to the upright and configured to receive a tape roll therein;

a roller connected to the base;

a cutter connected to the base, the cutter comprising a cylinder having a blade connected thereto and configured to move along an outer surface of the cylinder, wherein the cutter is movable between an idle position, wherein the blade is disposed away from the tape and behind the roller and a cut position, wherein the blade is disposed between the roller and the tape, and wherein the blade is configured to move across a length of the cutter;

inserting a tape roll into the tape housing, such that the tape roll is rotatable within the tape housing;

unwinding the tape roll and extending a portion of the tape in contact with and about the roller, such that an adhesive side of the tape is disposed opposite the roller and configured to be applied to the fixed substrate;

positioning a tape machine in a first position upon the fixed substrate;

directing the tape machine to a second position upon the fixed substrate, thereby applying the tape to the fixed substrate to form a boundary line for a field of play from the first position to the second position;

actuating a cutter position lever to move the cutter from an idle position to a cut position; and actuating a blade actuation lever to move the blade across a length of the cutter thereby cutting the tape.

16. The method of claim 15 wherein the cutter lever is cable actuated.

17. The method of claim 15 wherein the blade actuation lever is cable actuated.

18. The method of claim 15 wherein the upright comprises a pair a pair of upright members extending upwardly from opposing sides of the base; and wherein the tape machine further comprises a handle that extends between the pair of upright members.

19. The method of claim 18 wherein the tape machine further comprises a laser guide operatively coupled to the handle, wherein the laser guide is configured to direct a laser point at a location in front of the tape machine.

20. The method of claim 19 wherein:

the fixed substrate is a floor, and wherein the floor is a first color;

the tape is a second color; and the first color is different that the second color, such that the boundary lines forming the field of play composed of the tape are visually apparent on the floor.

* * * * *